United States Patent [19]

Wilson

[11] 4,237,976

[45] Dec. 9, 1980

[54] HYDRAULIC WELL PUMPING METHOD

[75] Inventor: Phillip M. Wilson, Downey, Calif.

[73] Assignee: Kobe, Inc., Huntington Park, Calif.

[21] Appl. No.: 66,010

[22] Filed: Aug. 13, 1979

[51] Int. Cl.[3] ..... E21B 43/00

[52] U.S. Cl. ..... 166/297; 166/314; 166/315; 166/105

[58] Field of Search ..... 166/314, 315, 68, 69, 166/105, 106, 107, 297; 417/53

[56] References Cited

U.S. PATENT DOCUMENTS

| | | | |
|---|---|---|---|
| 2,260,127 | 10/1941 | Tebbetts, Jr. | 166/68 |
| 3,126,965 | 3/1964 | Lindsey | 166/68 |
| 3,161,140 | 12/1964 | Bloudoff | 166/68 |
| 3,249,054 | 5/1966 | Hill | 166/68 X |
| 3,282,340 | 11/1966 | Park | 166/106 |
| 3,675,720 | 7/1972 | Sizer | 166/68 X |
| 3,708,013 | 1/1973 | Dismukes | 166/297 X |
| 3,789,923 | 2/1974 | Garrett | 166/297 X |
| 3,833,060 | 9/1974 | Craggs et al. | 166/68 |

*Primary Examiner*—Stephen J. Novosad
*Attorney, Agent, or Firm*—Christie, Parker & Hale

[57] ABSTRACT

Production tubing extends through a well bore to a well producing formation, and after well fluid stops flowing through the tubing under reservoir pressure, the well fluid is hydraulically pumped to the surface through the existing tubing, which avoids pulling the tubing and replacing it with a separate tubing and bottom hole assembly. The existing tubing is perforated, and a conduit or passageway for fluid flow is landed in the tubing below the perforations. The conduit comprises a combination of elements which include a lower tubing stop affixed to the tubing below a packing mandrel sealed to the inside wall of the tubing, and a receptacle and check valve above the packing mandrel. An upper landing nipple already installed in the existing tubing provides means for landing equipment for perforating the tubing and for landing elements of the conduit. A free pump is pumped down the tubing, with an upper portion of the pump being seated on the upper landing nipple while a lower portion of the pump makes a sliding seal in the receptacle. The pump is operated to pump well fluid from the well up through the conduit and then out through the perforations in the tubing and up the annulus between the tubing and the well bore to the surface.

27 Claims, 2 Drawing Figures

HYDRAULIC WELL PUMPING METHOD

BACKGROUND

This invention relates to hydraulic pumping of oil wells, and more particularly to a method of installing a pump in existing production tubing so that well fluid can be hydraulically pumped up the existing tubing without requiring removal of the tubing and replacement with another production tubing having a bottom hole assembly.

In the production of offshore oil wells, for example, production tubing extends from an offshore platform down to the well site. Well fluid can flow up the tubing under reservoir pressure until the well quits flowing naturally, after which hydraulic pumping or a gas lift can be used to continue production from the well. A common practice in hydraulically pumping well fluid from an offshore well is to pull the production tubing and install a new string with a bottom hole assembly at the bottom of the new string. A pump installed on the bottom hole assembly continues production by pumping well fluid from the well up the new string. The pump can be installed by conventional wire line equipment, or the pump can be a free pump which is pumped down the new string and coupled to the bottom hole assembly above the well. When production is finished, the free pump can be uncoupled from the bottom hole assembly and pumped to the surface.

Use of a bottom hole assembly is costly, especially when considering the expense of pulling the existing tubing and installing a new string with a bottom hole assembly.

A gas lift also can be used to continue production of well fluid after the well stops flowing by natural reservoir pressure. However, a gas lift can be expensive because of the need for compressors, natural gas supplies, and added equipment.

The present invention provides a method for hydraulically pumping well fluid from a well after the well stops flowing naturally, without requiring the production tubing to be pulled and without requiring use of a bottom hole assembly or a gas lift.

SUMMARY OF THE INVENTION

Briefly, one embodiment of this invention comprises a method for pumping well fluid from a well at the bottom of a well bore after the well fluid has stopped flowing naturally from the well up through a production tubing installed in the well bore. The method includes the steps of perforating the tubing, sealing a landing inside the tubing below the perforations, securing a pump to a portion of the landing, and operating the pump to pump well fluid from the well up through the interior of the tubing and out through the perforations and then up through the annulus between the tubing and the well bore. Thus, continued use can be made of the existing production tubing, which avoids installation of new production tubing and a bottom hole assembly, or use of a gas lift.

In another form of the invention, well fluid is hydraulically pumped from the well by peforating the tubing, providing a conduit or passageway for the flow of fluid inside the tubing, sealing the annular space between the conduit and the inside of the tubing below the perforations, pumping a free pump down the tubing and sealing the free pump to the conduit, and operating the pump to draw well fluid up through the conduit and then out through the perforations and up the annulus between the tubing and the well bore.

An existing upper landing in the tubing can be used to seat equipment used to perforate the tubing and then install a lower landing for the pump below the perforations. An upper portion of the pump can be seated on the upper landing while a lower portion of the pump is sealed to the lower landing.

These and other aspects of the invention will be more fully understood by referring to the following detailed description and the accompanying drawings.

DRAWINGS

FIG. 1 is a fragmentary, semi-schematic side elevation view, partly in cross-section, showing a method for perforating a production tubing extending to a well site; and FIG. 2 is a fragmentary, semi-schematic side elevation view, partly in cross-section, showing a method for installing a pump in the production tubing according to principles of this invention.

DETAILED DESCRIPTION

Figure 1:
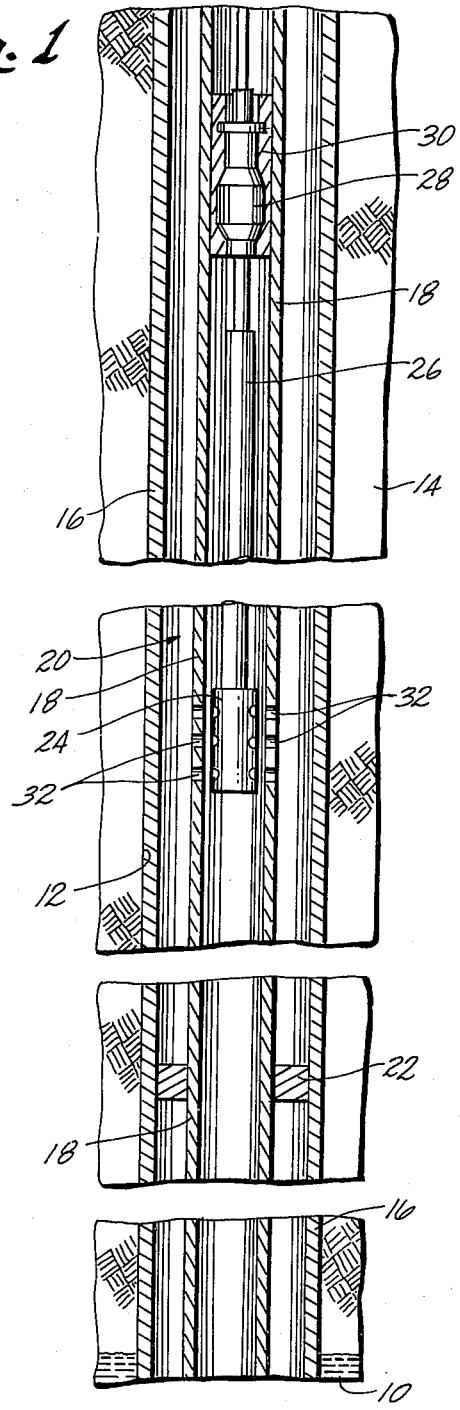

FIG. 1 schematically illustrates a system for flowing well fluid 10 such as crude oil from a underground well to the ground surface. One use of the invention is in offshore production of oil wells. The system includes a vertical well bore 12 in an underground formation 14. The bottom of the well bore opens into the well containing the well fluid. The wall of the well bore is supported by a tubular casing 16. Production tubing 18 extends down through the central portion of the casing from ground surface to the well. An annulus 20 is formed between the outside of the production tubing and the inside of the casing. An annular bottom seal 22 seals off a lower portion of the annulus 20 above the well. Well fluid can flow naturally from the well up through the production tubing as long as sufficient reservior pressure exists in the well. Well fluid is not shown inside the casing and the tubing for simplicity.

After the well fluid stops flowing naturally, further production is provided by hydraulically pumping the well fluid up the tubing. This can be accomplished without pulling the tubing and installing a bottom hole assembly, or without using a gas lift. FIG. 1 illustrates initial preparation of the tubing for hydraulic pumping. A tubing perforator 24 is lowered down the inside of the tubing on a string 26. The top of the string includes a locking mandrel 28, which can be an "S Type" locking mandrel manufactured by Otis Engineering Corporation. The mandrel is seated in an upper sleeve or landing nipple 30 illustrated schematically in FIG. 1. The landing nipple can be a "Type S" landing nipple manufactured by Otis Engineering Corporation. The locking mandrel and landing nipple position the perforator 24 at a selected elevation in the tubing. The perforator is then operated by conventional techniques for forming perforations 32 in the wall of the tubing. In the illustrated embodiment, three vertically spaced apart rows of circumferentially spaced apart holes are formed in the wall of the tubing by the perforator. The peforator can be any of several types of tubing perforators, i.e., a mechanically operated perforator, such as the "Type A" perforator manufactured by Otis Engineering Corporation, or a gun perforator, also referred to as a jet perforator, manufactured by Brown Oil Tools, Inc.

The lower interior region of the tubing can be packed off for sealing against flow from a bottom producing well before perforating the tubing. The packer can be lowered into position near the bottom of the tubing by a wire line (not shown). Similarly, the tubing perforator can be lowered down the tubing by wire line equipment.

There can be a number of landing nipples 30 spaced vertically apart along the length of the tubing. Such landing nipples can be installed in the tubing prior to production and left in place while the well is flowing. They can be used as landings for servicing equipment, for example. Any one of the several existing landing nipples can be used to seat the tubing perforator, depending upon the desired location of the perforations to be formed in the tubing.

Figure 2:
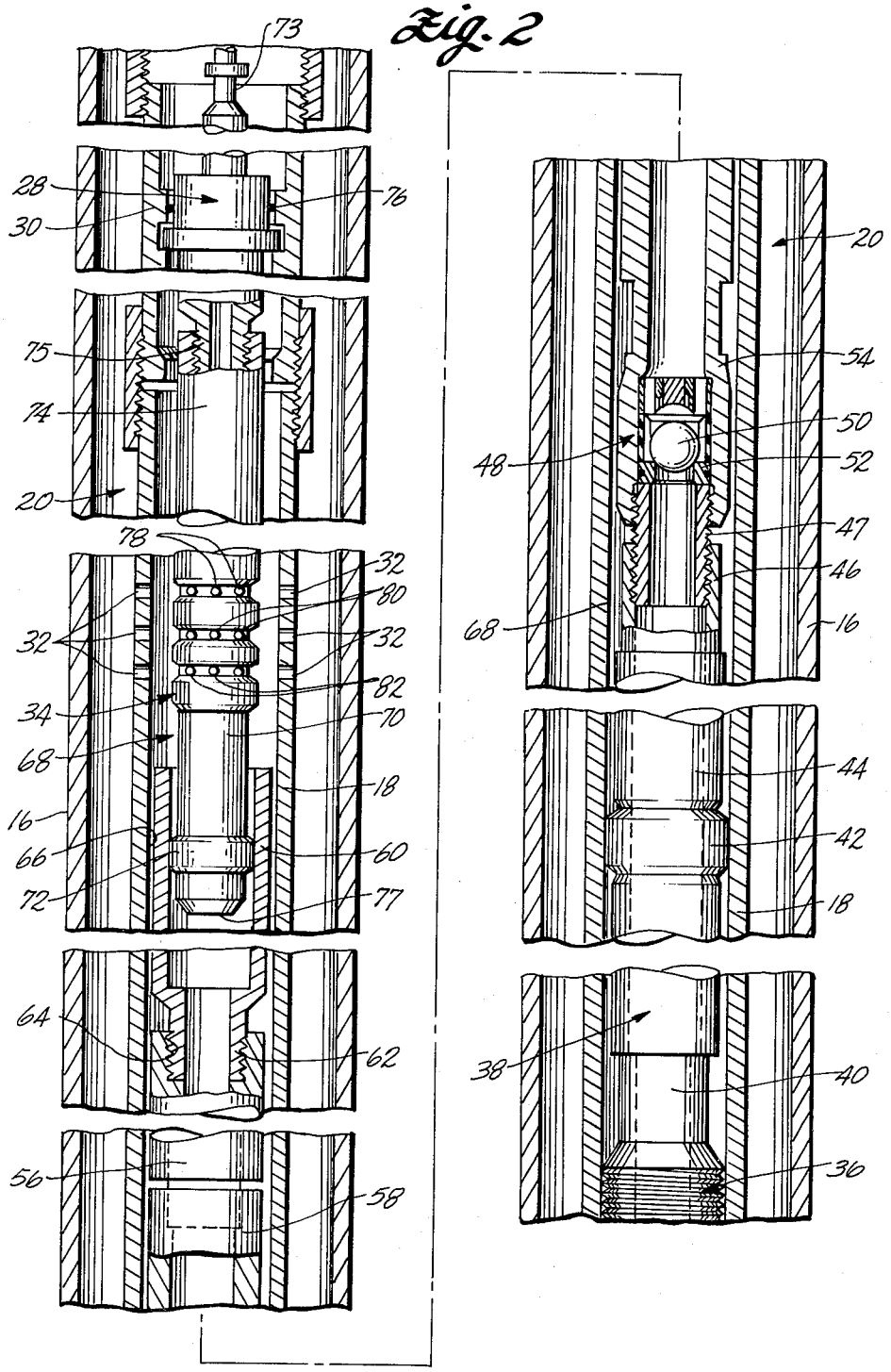

Following perforation of the tubing, the perforator is removed from the tubing and a lower landing is then installed in the tubing below the perforations 32 for seating a pump 34 that is eventually used for hydraulically pumping well fluid upwardly through the tubing for continuing production from the well. The lower landing includes a tubing stop 36 which is first lowered down the tubing, say by a wire line, and then landed at a selected distance below the perforations. The upper landing nipple 30 can be used as a landing for the wire line equipment used to seat the tubing stop in the tubing. The known elevation of the landing nipple can be used as a locator to position the tubing stop at a known distance below the perforations in the wall of the tubing. The tubing stop 36, which is illustrated only in part in FIG. 2, includes a threaded section which is expanded outwardly for engaging the inside wall of the tubing for preventing downward movement of equipment landed on the tubing stop. The tubing stop has a central bore to permit flow of fluid through it. The tubing stop can be the BFC Model B Tubing Stop, manufactured by Baker Packers, a division of Baker International Corporation.

The lower landing also includes a packing mandrel 38 that is landed on the tubing stop. The packing mandrel includes a tubular lower section 40 having a coupling for interlocking the packing mandrel to the upper portion of the tubing stop. The packing mandrel also includes an annular seal 42 for being sealed against the inside wall of the tubing below the peforations 32. The packing mandrel is tubular to provide a conduit for fluid flow while the seal 42 provides a seal between such a conduit and the inside wall of the tubing. A tubular upper section 44 of the packing mandrel provides a sleeve for coupling to a landing shoe assembly described below. The packing mandrel can be lowered down the tubing by a wire line (not shown). The seal 42 can be expanded outwardly adjacent the wall of the tubing after the packing mandrel is seated on the tubing stop. The packing mandrel 38 can be a lower packoff assembly which is a component of the BFC Model K-3 Straddle Packoff manufactured by Baker Packers.

After the tubing stop and packing mandrel are landed, a landing shoe assembly 46, a standing valve 48, a safety valve 56 and a receptacle 60 are assembled as a unit and lowered down the tubing by a wire line and coupled to the sleeve in the upper portion 44 of the packing mandrel. The landing shoe assembly 46 comprises a sleeve with an internally threaded tubular section coupled to an externally threaded tubular section 47 at the bottom of the standing valve. The landing shoe assembly can have a retractable and expandable tubular section for being lowered into the tubular upper portion of the packing mandrel and expanded outwardly to interlock with the packing mandrel. A suitable landing shoe assembly is a component of the Model K-3 Straddle Packoff manufactured by Baker Packers.

The standing valve 48 includes a ball check valve 50 for permitting well fluid to flow upwardly from the producing formation and for preventing reverse flow of well fluid past the check valve down the tubing. The ball check valve 50 seats on a valve seat 52 in a tubular body 54 of the standing valve. Upward flow of fluid can lift the ball from the valve seat to permit upward flow of fluid through the standing valve. The ball seats on the valve seat to prevent reverse downward flow of fluid past the standing valve.

The safety valve 56 can be installed above the standing valve 48. The safety valve is illustrated schematically since it is not part of the present invention. The safety valve is coupled to a tubular upper portion 58 of the standing valve so that fluid flowing through the standing valve then flows into the safety valve. Briefly, the safety valve can prevent the well from flowing fluid through the tubing to the surface by means of the well's own natural reservoir pressure.

Installed above the safety valve is a tubular receptacle 60 having an externally threaded lower portion 62 coupled to an internally threaded bore 64 at the upper end of a passageway through the safety valve. The receptacle 60 comprises an elongated tubular body with an open upper end and a long straight bore 66 extending through the receptacle to an open lower end communicating with the passageway from the safety valve. The long bore in the receptacle provides a seat for the nose of the pump 34 when the pump is installed in the receptacle.

The receptacle 66, safety valve 56, standing valve 48, and landing shoe assembly 46 are pre-assembled as a unit and then lowered down the tubing by a wire line for coupling the landing shoe assembly to the upper section 44 of the packing mandrel 38. The combined upper receptacle, safety valve, standing valve, landing shoe assembly, packing mandrel and tubing stop 36 function as a unit to provide an independent conduit or passageway for fluid flow through the tubing, in which the exterior of the conduit is sealed to the interior wall of the tubing by the seal 42, and in which the ball check valve and safety valve control flow of fluid through the conduit. The seal 42 provides a lower seal, below the perforations 32, for pressurized fluid communicating with the perforated portion of the tubing in an annulus 68 between the conduit and the tubing.

The lower portion of the pump 34 has a tubular nose 70 adapted to make a sliding seal inside the tubular receptacle 60. An O-ring seal 72 carried on the exterior of the nose seals to the inside wall of the receptacle. The pump depicted in the drawings can be a "free pump", i.e., a pump that can be passed down from the surface through the tubing by hydraulic pressure and releasably seated in the receptacle. The free pump is pumped down the tubing by fluid under pressure applied from the surface, and the pump can be removed from the receptacle and pumped to the surface by reversing the flow of fluid. The free pump illustrated in the drawings could be a piston-type free pump, and an example of such a free pump is the "Type A" hydraulic bottom hole piston pump manufactured by Kobe, Inc. Alternatively, other types of free pumps could be used, such as a jet pump or turbine pump.

The locking mandrel 28 has a tubular upper portion 73, also referred to as a running neck, that includes an inlet port (not shown) for receiving power fluid under high pressure from the tubing. The power fluid passes down through the passageway in the locking mandrel 28 and into the interior of the pump for operating the pump piston. An upper portion 74 of the pump 34 is attached to a tubular lower section 75 of the locking mandrel 28. An annular upper seal 76 seals the locking mandrel inside the landing nipple 30. The upper seal 76 and the lower seal 42 provide a sealed interior region in the annulus 68 inside the tubing between the upper and lower seals. The upper seal isolates this region of the tubing from the region above the upper seal in which power fluid under high pressure is pumped for operating the free pump. The locking mandrel locks to stop movement in the downward direction but allows movement in the upward direction for pump removal.

The pump can be a reciprocating piston pump having a suction at an intake port 77 at the bottom of the free pump for drawing well fluid into the pump. Once the free pump has been seated in the receptacle 60, oil or other hydraulic fluid under high pressure, referred to as power fluid, can be pumped down the portion of the tubing above the upper seal 76 to actuate the pump. The pump preferably has three series of circumferentially spaced apart discharge ports at three levels between the upper and lower seals, namely, a first series of upper discharge ports 78, a second series of intermediate discharge ports 80, and a third series of lower discharge ports 82. The power fluid actuates the lower piston and causes well fluid to flow upwardly from the well through the conduit or passageway extending through the tubing stop, packing mandrel, standing valve, safety valve and receptacle 60 and into the intake port of the free pump. Oil drawn into the pump from the well is discharged from the lower two series of discharge ports 80, 82. Exhaust power fluid from operation of the pump is discharged through the upper series of discharge ports 78. Exhaust power fluid and production well fluid discharged from the discharge ports are commingled in the annulus 68 between the pump and the inside wall of the power fluid tubing. The perforations 32 in the tubing communicate with the annulus 68, and the commingled fluid flows from the annulus inside the tubing through the perforations in the tubing and into the annulus 20 between the tubing and the casing 16. The commingled fluid is then returned to the surface. Continued pumping of power fluid for actuating the pump continuously draws production well fluid from the well and circulates it through the perforations and then through the annulus 20 to the surface.

The packing mandrel, landing shoe assembly, standing valve, safety valve, and receptacle for the pump are landed on the tubing stop so that the receptacle is positioned a predetermined distance below the landing nipple 30, such that when the free pump is landed on the landing nipple, the nose of the free pump simultaneously seals inside the receptacle. The tubing is initially perforated a predetermined distance below the landing nipple such that when the pump is positioned in the receptacle, the outlet ports of the pump are in communication with the annulus 68 which, in turn, is in communication with the perforations of the tubing between the upper seal 74 and the lower seal 42.

Thus, the well can be produced after it stops flowing by natural reservoir pressure. The production tubing can be perforated by using the existing landing nipple 30 as an upper landing for the perforating equipment. The landing nipple then can be used as an upper landing while installing the lower landing for the pump. The existing tubing is then used to provide means for conducting well fluid to the surface during operation of the pump. This avoids the common practice of pulling the production tubing and installing a new string with a bottom hole assembly for accepting a conventional hydraulic pump. In addition, the method of this invention can avoid the need for using a gas lift which can be expensive because of the need for natural gas supplies, compressors, added tubing, and the like. When production is to be terminated, hydraulic fluid can be circulated from the annulus 20 outside the tubing and in through the perforations in the tubing and then up beneath the free pump to force the pump upwardly through the tubing to the surface.

I claim:

1. A method for pumping well fluid from a well at the bottom of a well bore after the well fluid has stopped flowing naturally from the well up through a tubing installed in the well bore, comprising the steps of:

perforating the tubing;

sealing a landing means inside the interior of the tubing below the perforations;

securing a pump to a portion of the landing means; and operating the pump to pump well fluid from the well up through the interior of the tubing and out through the peforations and then up through the annulus between the tubing and the well bore.

2. The method according to claim 1 in which the landing means includes conduit for fluid flow inside of the tubing, a seal between the conduit and the tubing, a tubing stop for maintaining the conduit in a fixed position in the tubing, and a receptacle above the seal; and including the steps of securing the tubing stop to the interior of the tubing below the perforations, sealing the conduit to the interior of the tubing below the perforations, and then securing the pump to the receptacle.

3. The method according to claim 1 including providing a landing sleeve in the tubing above the perforations; securing a mandrel to the pump; and releasably seating the mandrel on the landing sleeve for maintaining the pump in a fixed position in the tubing while the pump is secured to said portion of the landing means.

4. The method according to claim 3 including sealing the pump to the landing means by a sliding seal between the pump and said portion of the landing means.

5. The method according to claim 4 including providing a lower seal between the inside of the tubing and a lower passageway for flowing well fluid to the pump; providing an upper seal between the inside of the tubing and an upper passageway for flowing power fluid to the pump; wherein the upper passageway is independent of the lower passageway; and providing the peforations between the upper and lower seals.

6. The method according to claim 4 in which said portion of the landing means to which the pump is secured includes valve means for controlling flow of well fluid in the tubing from below the landing means to the pump, and a receptacle above the valve means in which the pump is releasably sealed.

7. The method according to claim 1 in which the landing means includes a tubular passageway and a receptacle above the tubular passageway; and including securing the tubular passageway against movement relative to the tubing, sealing the tubular passageway to the interior of the tubing, and releasably sealing the pump to the receptacle via a sliding seal inside the receptacle.

8. The method according to claim 7 including simultaneously seating an upper portion of the pump in a fixed landing sleeve in the tubing while releasably securing a lower portion of the pump in the receptacle.

9. The method according to claim 8 including providing the perforations between the sleeve and the receptacle.

10. The method according to claim 1 including removing the pump from the tubing by forcing fluid under pressure from the annulus through the perforations and into the tubing below the pump.

11. A method for pumping well fluid from a well at the bottom of a well bore having an existing tubing in the well bore communicating with the well for conducting well fluid up from the well, the tubing having at least one landing sleeve therein, comprising the steps of:

perforating the tubing below such a landing sleeve;

sealing a receptacle inside the tubing;

lowering a pump down the tubing;

releasably securing a portion of the pump to the landing sleeve and sealing a portion of the pump to the receptacle; and operating the pump to pump well fluid from the well up the tubing and out through the perforations and then up an annulus between the tubing and the well bore.

12. The method according to claim 11 including removing the pump from the tubing by forcing fluid from the annulus through the perforations and upwardly into the tubing below the pump.

13. The method according to claim 11 including positioning the receptacle a selected distance below the landing sleeve so that when the pump is secured to the landing sleeve, the pump is simultaneously sealed to the receptacle.

14. The method according to claim 11 including providing a sliding seal between the pump and the receptacle.

15. The method according to claim 11 in which the pump is a free pump, and the free pump is pumped down the tubing and releasably and slidably sealed to the receptacle.

16. A method for hydraulically pumping well fluid from a well at the bottom of a well bore after the well fluid stops flowing upwardly, under reservoir pressure, from the well through a tubing installed in the well bore, comprising the steps of:

perforating the tubing;

providing a conduit for the flow of fluid inside the tubing;

sealing the annular space between the conduit and the inside of the tubing below the perforations;

placing a pump in the tubing to provide fluid communication between the conduit and the pump; and operating the pump to pump well fluid up through the tubing, into the conduit and then from the pump through the perforations in the tubing and up through the annular space between the tubing and the well bore.

17. The method according to 16 in which the pump is a free pump, and the pump is placed in the tubing by flowing fluid together with the pump down the tubing and out through the perforations.

18. The method according to claim 16 including providing an upper conduit for flow of power fluid from the tubing to the pump, and sealing the annular space between the upper conduit and the inside of the tubing, for providing a sealed annular space having upper and lower seals on opposite sides of the perforations.

19. The method according to claim 18 in which outlet ports of the pump communicate with the sealed annular space to commingle exhaust power fluid and well fluid in said sealed annular space.

20. The method according to claim 16 including installing a check valve in the conduit for preventing flow of fluid from the pump down through the conduit below the seal.

21. The method according to claim 16 including perforating the tubing above an annular seal between the outside of the tubing and the well bore.

22. A method for hydraulically pumping well fluid from a well at the bottom of a well bore after the well fluid stops flowing naturally from the well up through an existing tubing installed in the well bore, wherein the existing tubing has at least one landing sleeve, comprising the steps of:

perforating the tubing below the upper landing and above an annular seal between the tubing and the well bore, the landing sleeve providing an upper landing;

placing a lower landing in the tubing below the perforations;

providing a receptacle in the tubing above the lower landing;

providing a conduit for flow of well fluid from below the lower landing to the receptacle;

sealing the annular space between the conduit and the inside of the tubing below the receptacle;

lowering a pump down the tubing;

seating an upper portion of the pump on the upper landing while releasably seating a lower portion of the pump in the receptacle; and operating the pump to pump well fluid from the well through the conduit and out through the perforations and up the annulus between the tubing and the well bore.

23. The method according to claim 22 in which the pump is a free pump, and including pumping the free pump down the tubing by circulating hydraulic fluid down the tubing and out through the perforations.

24. The method according to claim 22 including removing the pump from the tubing by forcing fluid from the annular space between the tubing and the well bore through the perforations and then into the tubing below the pump.

25. The method according to claim 22 including sealing the annular space between the upper landing and an upper conduit communicating with the pump, so that seals are provided above and below the perforations.

26. The method according to claim 22 including providing a sliding seal between the lower portion of the pump and the receptacle.

27. The method according to claim 22 including landing a tubing perforator on the upper landing, perforating the tubing with the perforator, and removing the perforator from the tubing.

* * * * *